US007391334B2

(12) United States Patent
Miyake et al.

(10) Patent No.: US 7,391,334 B2
(45) Date of Patent: Jun. 24, 2008

(54) CONNECTION CHECKING SYSTEM, PRINTER DEVICE, METHOD OF CHECKING CONNECTED STATE, CONNECTION CHECKING PROGRAM, AND RECORDING MEDIUM STORING CONNECTION CHECKING PROGRAM

(75) Inventors: Kouji Miyake, Nara (JP); Hiroshi Ishii, Osaka (JP); Hideyuki Hiro, Nara (JP); Kenji Tanaka, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 241 days.

(21) Appl. No.: 11/207,145

(22) Filed: Aug. 17, 2005

(65) Prior Publication Data

US 2006/0038693 A1 Feb. 23, 2006

(30) Foreign Application Priority Data

Aug. 18, 2004 (JP) ..... 2004-238458

(51) Int. Cl.
*G08B 21/00* (2006.01)

(52) U.S. Cl. ..... 340/653; 340/657; 439/489

(58) Field of Classification Search ..... 340/653, 340/657, 635, 660; 439/489
See application file for complete search history.

(56) References Cited

U.S. PATENT DOCUMENTS 5,347,265 A * 9/1994 Shimura ..... 340/653
5,481,377 A * 1/1996 Udagawa et al. ..... 358/501

FOREIGN PATENT DOCUMENTS

| | | |
|---|---|---|
| JP | 62-267674 | 11/1987 |
| JP | 8-1388 | 9/1996 |
| JP | 2000-196627 A | 7/2000 |
| JP | 2000-305676 A | 11/2000 |
| JP | 2002-229693 | 8/2002 |

OTHER PUBLICATIONS

Nippon Dennkl 78KO/KE1 user's manual (U162228 JJV0UD00), NEC Electronics Corporation, Jan. 2003, pp. 2, 41-54.

* cited by examiner

*Primary Examiner*—Phung T. Nguyen
(74) *Attorney, Agent, or Firm*—Edwards Angell Palmer & Dodge LLP; David G. Conlin; William J. Daley, Jr.

(57) ABSTRACT

A connection checking system of the present invention is arranged so as to apply a power supply voltage which is dropped by the resistance to a terminal when the control substrate and the unit are connected. Then, the control section determines that the unit is connected to the control substrate when the dropped voltage is applied to the terminal. On the other hand, when a dropped voltage is not applied to the terminal, the control section determines that the unit is not connected to the control substrate. The connection checking system of the present invention can be realized by using a conventional power supply cable, a signal cable and a terminal, and thus the connection checking system of the present invention can be manufactured at low costs.

17 Claims, 6 Drawing Sheets

CONNECTION CHECKING SYSTEM, PRINTER DEVICE, METHOD OF CHECKING CONNECTED STATE, CONNECTION CHECKING PROGRAM, AND RECORDING MEDIUM STORING CONNECTION CHECKING PROGRAM

This Non-provisional application claims priority under 35 U.S.C. § 119(a) on Patent Application No. 2004-238458 filed in Japan on Aug. 18, 2004, the entire contents of which are hereby incorporated by reference.

FIELD OF THE INVENTION

The present invention relates to a connection checking system for determining the connected state of a connecting member which connects an electric device and a unit.

BACKGROUND OF THE INVENTION

Conventionally, in printers, a plurality of unit substrates are provided such as a memory substrate, etc., other than a main substrate (control substrate), and such unit substrates are connected by cables or slots, etc.

In a system with a function of printing image data obtained from a personal computer (PC) by a printer, the PC and the printer are connected by a cable.

Namely, a printer is used by connecting a plurality of units (unit substrates, PC) to a device main body (printer main body, main substrate).

Japanese Unexamined Utility Model Publication 8-001388/1996 (published on Sep. 13, 1996), and Japanese Unexamined patent publication 62-267674/1987 (published on Nov. 20, 1987) disclose the technique (connection checking system) for detecting if the foregoing unit is appropriately mounted to the device.

According to the connection checking system of Japanese Unexamined Utility Model Publication 8-001388/1996, a detection terminal is mounted to the connector installation section of the substrate, and a short-circuit elastic contact terminal is provided outside the cabinet of the connector of a cable for connecting the unit, and the mounted state of the connector is checked by detecting if the detection terminal and the short-circuit elastic contact terminal are conducted.

Japanese Unexamined patent publication 62-267674/1987 discloses the connection checking system for determining the state (ON or OFF) (connected state of each sensor) of a device provided with a plurality of sensors (units).

In the foregoing conventional structure, a determination voltage is applied to a circuit (ladder circuit) wherein a plurality of paired series of resistance and sensor are connected in parallel and current flows in a resistance which makes a pair with the sensor in the ON state. Further, by setting the respective values of the resistances (partial pressure ratio) to be appropriate values and measuring a total amount of voltage dropped in the overall circuit, the state (ON or OFF) of each sensor can be detected.

In the connection checking system of Japanese Unexamined Utility Model Publication 8-001388/1996, a detection terminal and an elastic contact terminal dedicated for checking the connected state are needed, and a problem therefore arises in that the manufacturing cost of the device increases.

Also in the connection checking system of Japanese Unexamined patent publication 62-267674/1987, special wiring and terminal are needed for the application of the determination voltage, and the foregoing problem of an increase in the manufacturing cost of the device cannot be avoided.

SUMMARY OF THE INVENTION

It is an object of the present invention to provide a connection checking system which can be manufactured at low costs.

In order to achieve the foregoing object, the connection checking system of the present invention for checking a connected state of a connecting member which connects an electronic device and a unit, is characterized by including:

a connecting member which includes a power supply cable for supplying a power supply voltage from an electronic device to a unit, and a first signal cable for sending a control signal as outputted from a first signal terminal of the electronic device to the unit; and a control section which makes a determination on the connected state of the connecting member, wherein when the connecting member is connected to the unit, the first signal cable is connected to the power supply cable via a first resistance in the unit; and the control section makes a determination on the connected state of the connecting member based on a voltage applied to the first signal terminal.

According to the foregoing structure of the connection checking system, when the connecting member is connected to the unit, the first signal cable is connected to the power supply cable via the first resistance in the unit.

Therefore, in the state where the connecting member is connected to both the electronic device and the unit, a power supply voltage is dropped by the first resistance, and the power supply voltage as dropped is applied to the first signal terminal via the first signal cable.

In this case, the voltage (dropped voltage) applied to the first signal terminal is determined based on the power supply voltage and the first resistance value.

The connection checking system of the present invention is provided with the control section for determining the connected state of the connecting member based on the voltage applied to the first signal terminal.

Namely, when the dropped voltage is applied to the first signal terminal via the first signal cable, the control section determines that the connecting member is connected to the unit and the electronic device (the unit is connected to the electronic device).

On the other hand, when the dropped voltage is not applied to the first signal terminal, the control section determines that the connecting member is disconnected from at least either one of the unit and the electronic device (the unit is not connected to the electronic device).

As described, according to the connection checking system of the present invention, by only determining (measuring) the voltage applied to the first signal terminal in the electronic device, it is possible to check the connected state of the connecting member with respect to the electronic device and the unit. As a result, the connected state of the connecting member can be checked in quite simple manner.

For a fuller understanding of the nature and advantages of the invention, reference should be made to the ensuing detailed description taken in conjunction with the accompanying drawings.

DESCRIPTION OF THE EMBODIMENTS

The following descriptions will explain one embodiment of the present invention in reference to the Figures.

The printer device in accordance with the present embodiment (the printer device of the present embodiment; the electronic device) is provided for printing image data as received from the external equipment onto printing paper (sheet) and outputting the printing paper with the image printed thereon.

Figure 1:
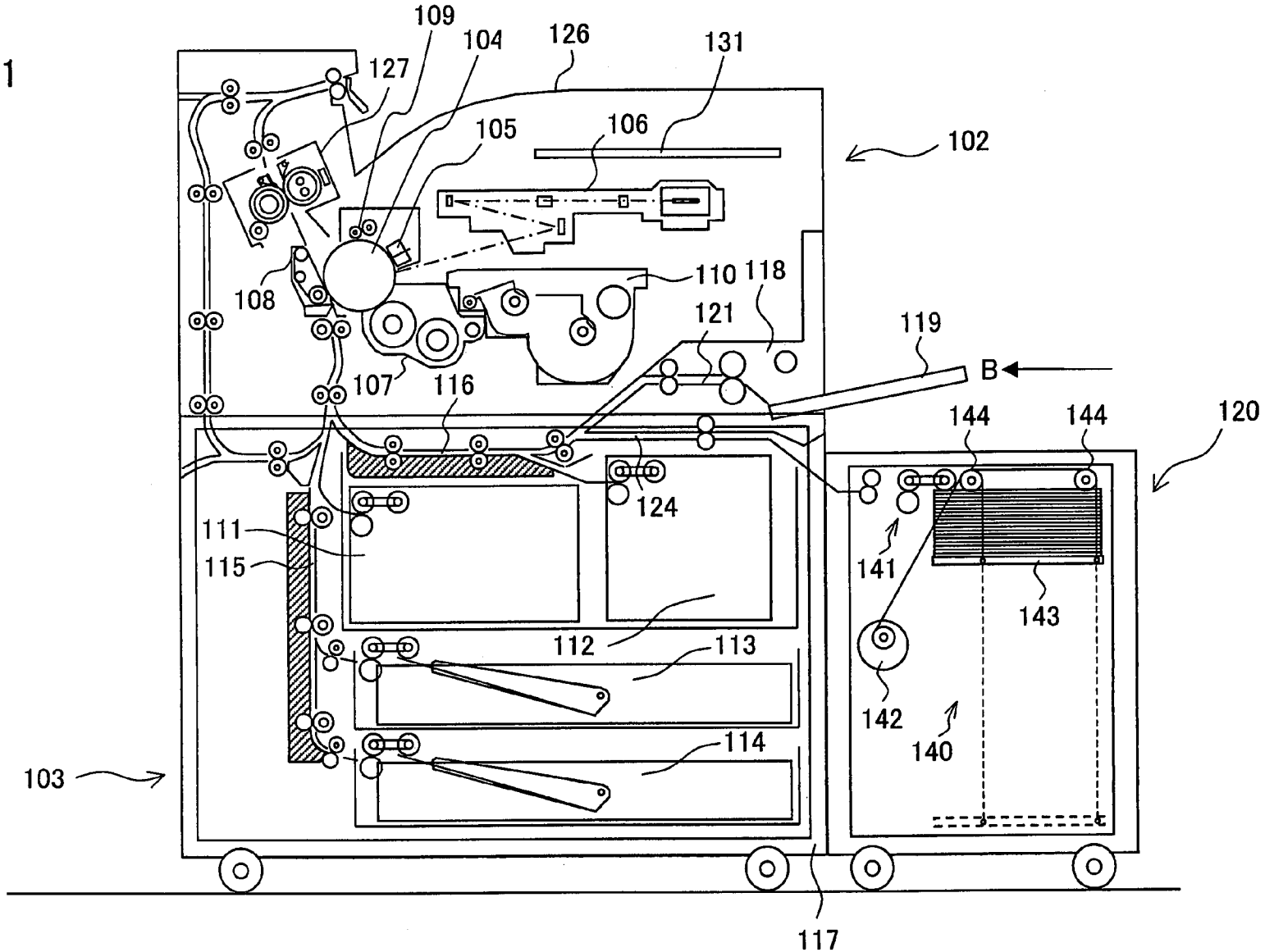
FIG. 1 is an explanatory view illustrating the structure of the printer device in accordance with one embodiment of the present invention.

FIG. 1 is an explanatory view illustrating the structure of the printer device of the present embodiment.

As illustrated in FIG. 1, the printer device of the present embodiment includes a printer section 102, a paper feeder unit section 103 provided under the printer section 102, a large paper stack capacity feeder unit 120 provided on the right hand side of the paper feeder unit section 103, and a discharge tray 126 provided on the printer section 102.

The printer section 102 is provided for printing an image onto a sheet based on image data as inputted from external equipment.

As illustrated in FIG. 1, the printer section 102 includes: an electro-photographic processing section provided at a center thereof, the electro-photographic processing section being made up of a photoreceptor drum 104, a charging unit 105, an optical scanning unit 106, a developing unit 107, a transfer unit 108, a cleaning unit 109, and a fuser unit 127 which are provided along the outer circumference of the photoreceptor drum 104.

The photoreceptor drum 104 is a drum shaped photoreceptor having a photosensitive material applied on the surface thereof. The charging unit 105 is provided for uniformly charging the surface of the photoreceptor drum 104.

The optical scanning unit 106 scans the uniformly charged photoreceptor drum 104 with a laser light having intensity modulated according to the image data, thereby writing an electrostatic latent image on the photoreceptor drum 104.

The developing unit 107 develops (visualizes) the electrostatic latent image written by the optical scanning unit 106 using a developing material (toner, etc.), and generates a developing material image.

The transfer unit 108 transfers the developing material image formed on the photoreceptor drum 104 onto the sheet.

The fuser unit 127 is provided for heat-fusing the image (developing material image) as transferred onto the sheet to make the image be affixed onto the sheet.

The cleaning unit 109 is provided for removing the developing material remaining on the photoreceptor drum 104 after transferring the developing material image onto the sheet. As a result, it becomes ready to form a new latent image on the photoreceptor drum 104.

The residual developing material removed by the cleaning unit 109 is collected in the developing material supply section of the developing unit 107 for recycling.

The discharge tray 126 is provided for discharging the sheet with the image printed thereon by the printer section 102.

The paper feeder unit section 103 is provided for storing sheets for use in printing, and supplying sheets to the printer section 102 when printing.

As illustrated in FIG. 1, the paper feeder unit section 103 is provided with a plurality of feeder units including paper feed trays 111 to 114, and a manual paper feeder unit 118, so that sheets in a variety of sizes and materials can be stored.

The paper feed trays 111 to 114 are feeder units provided within the frame of the paper feeder unit section 103.

The paper feed tray 111 and the paper feed tray 112 are provided in parallel in the upper part of the paper feeder unit section 103.

The paper feed tray 113 is provided under the paper feed trays 111 and 112, and further, the paper feed tray 114 is provided under the paper feed tray 113.

The paper feed tray 113 and the paper feed tray 114 have substantially the same paper stack capacity.

Furthermore, the paper stack capacities of the paper feed trays 111 and 112 are selected to be larger than the paper stack capacities of the paper feed trays 113 and 114.

When supplying sheets into each of the paper feed trays 111 to 114, the paper feed trays 111 to 114 are to be drawn to the front side of the printer device of the present embodiment (in the direction vertical to the sheet).

The manual paper feeder unit 118 is provided with a manual paper feed tray 119 onto which relatively a small number of sheets can be set directly and externally with ease.

As illustrated in FIG. 1, the paper feeder unit section 103 includes a first transport path 115, a second transport path 116, a third transport path 121, and a fourth transport path 124.

The first transport path 115 is provided so as to extend in the vertical direction along the frame 117 of the paper feeder unit section 103, and transports sheets from the paper feed trays 111, 113 and 114 to the printer section 102.

On the other hand, the second transport path 116 is formed in the direction vertical to the frame 117 (horizontal direction). This second transport path 116 transports sheets from the paper feed tray 112 to the printer section 102.

This second transport path 116 also functions to transport sheets from the manual paper feeder unit 118, and the large paper stack capacity feeder unit 120, as being supplied via the third transport path 121 and the fourth transport path 124, to the printer section 102.

The third transport path 121 is provided for transporting sheets from the manual paper feeder unit 118 to the second transport path 116.

The fourth transport path 124 is provided for transporting sheets from the large paper stack capacity feeder unit 120 to the second transport path 116.

The large paper stack capacity feeder unit 120 is an optional device to be mounted to the printer device of the present embodiment, and has a larger paper stock capacity than the paper feed trays 111 to 114 and the paper feed tray 119.

As illustrated in FIG. 1, the large paper stack capacity feeder unit 120 includes a lift tray section 140, and a pickup mechanism 141.

The lift tray section 140 includes a lift motor 142, an elevating tray 143, and a pulley 144. The elevating tray 143 is provided for storing stacked sheets (a bundle of sheets). The lift motor 142 and the pulley 144 are provided for elevating the elevating tray 143.

Further, the pickup mechanism 141 is provided for feeding sheets from the elevating tray 143 to the fourth transport path 124 of the paper feeder unit section 103.

The printer device of the present embodiment is provided with the control section 31 for controlling the overall operations of the printer device of the present embodiment.

Figure 2:
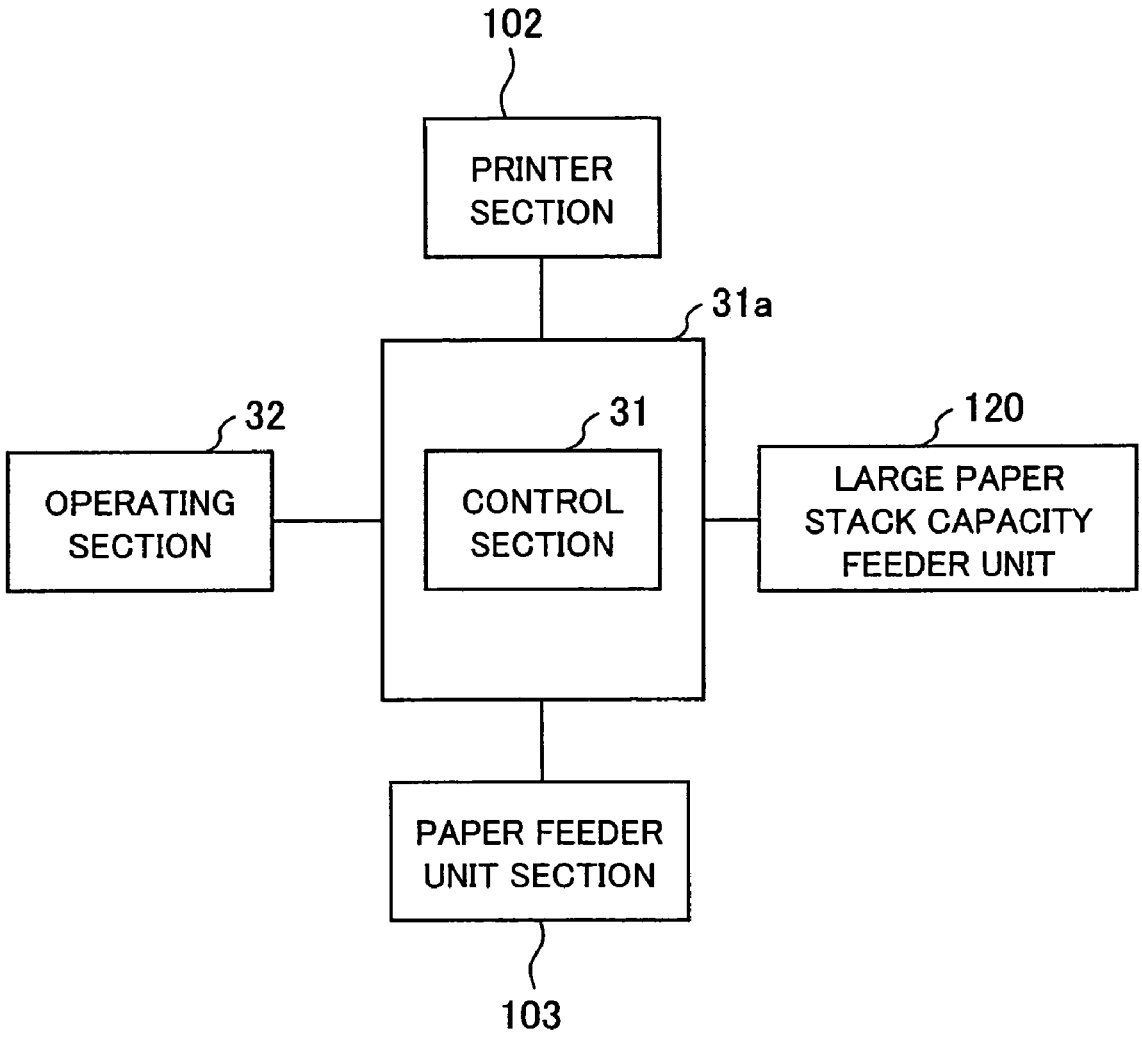
FIG. 2 is a block diagram illustrating the structure of a control mechanism of the printer device of FIG. 1.

FIG. 2 is a block diagram illustrating the control system in the printer device of the present embodiment.

As illustrated in FIG. 2, the printer device of the present embodiment includes an operating section 32 in addition to the printer section 102, the paper feeder unit section 103, the large paper stack capacity feeder unit 120, and the discharge tray 126 and, all of these members are controlled by the control section 31.

The operating section 32 is provided for receiving instructions as inputted by the user and transmitting the instructions to the control section 31. The operating section 32 is also provided with a display screen (not shown) for displaying a predetermined message to the user from the control section 31.

In the printer device of the present embodiment, when the image data is inputted from an external equipment, the control section 31 selects one of the paper feed trays 111 to 114 or the manual paper feeder unit 118 of the printer section 102, or one of the paper feeders selected from the large paper stack capacity feeder unit 120. Then, the control section 31 sends sheets from the paper feeder as selected to the area between the photoreceptor drum 104 and the transfer unit 108 of the printer section 102 a sheet by a sheet using the transport roller.

Further, the control section 31 controls each member of the printer section 102 based on the image data, and forms a developing material image on the photoreceptor drum 104. The resulting developing material image is then transferred (printed) onto a sheet, and the sheet with the image printed thereon is discharged onto the discharge tray 126.

Next, for the characteristic structures of the printer device of the present embodiment, the structure of the connection checking system (the connection checking system of the present embodiment) will be explained.

As illustrated in FIG. 2, the printer device of the present embodiment includes the control substrate (electronic device) 31*a* provided with the control section 31. To this control substrate 31*a*, connected by the cable with connectors (connecting member) are the printer section 102, the paper feeder unit section 103, the large paper stack capacity feeder unit 120, the discharge tray 126, and the operating section 32, or other members (hereinafter, referred to as units) which provide additional functions to the printer device of the present embodiment.

The foregoing control substrate 31*a* (the control section 31) controls these units by transmitting/receiving information, power to/from each unit via the cable with connectors.

The cable with connectors is made up of a bundle of wirings, and connectors provided at both ends. This cable is detachably connected to the control substrate 31*a* and the unit.

The connection checking system of the present embodiment then detects if the cable with connector is appropriately connected to the control substrate 31*a* and the unit U.

Figure 3:
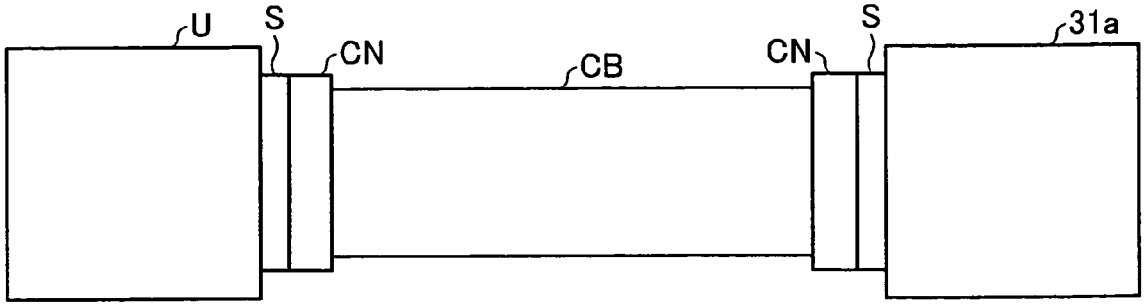
FIG. 3 is an explanatory view illustrating the connected state of the cable with connectors.

FIG. 3 is an explanatory view illustrating the connected state, where the control substrate 31*a* and a single unit U are connected to each other by a cable with connectors CB. As also illustrated in FIG. 3, the control substrate 31*a* and the unit U, are provided with pin connectors S respectively. The connectors CN provided at both ends of the cable with connectors CB are connected the pin connectors S at the connecting ends of the connectors CN.

The connection checking system of the present embodiment detects if the cable with connectors CB is connected to the control substrate 31*a* and the unit U.

First, the structure of the connection checking system of the present embodiment will be explained.

Figure 4:
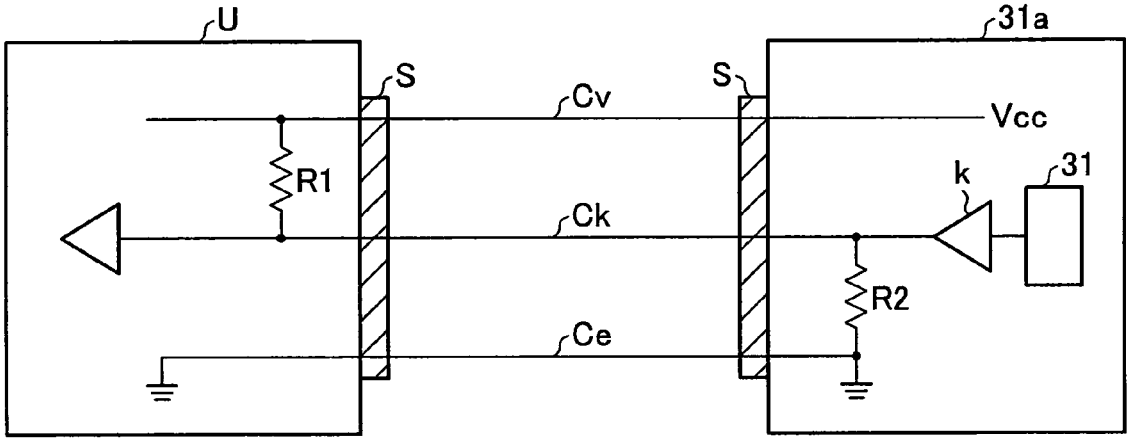
FIG. 4 is an explanatory view illustrating the connection detecting circuit in the connection checking system provided in the printer device of FIG. 1.

The connection checking system of the present embodiment includes the connection detecting circuit shown in FIG. 4, in addition to the control section 31. This connection detecting circuit includes a terminal (port) k of the control substrate 31*a*, a signal cable Ck, a power cable Cv, the ground cable Ce, the resistance R1 and the resistance R2.

The terminal k (first signal terminal) is connected to a single terminal pin of the pin connector S of the control substrate 31*a*. This terminal k is an output terminal for outputting control signals to the unit U.

Figure 5:
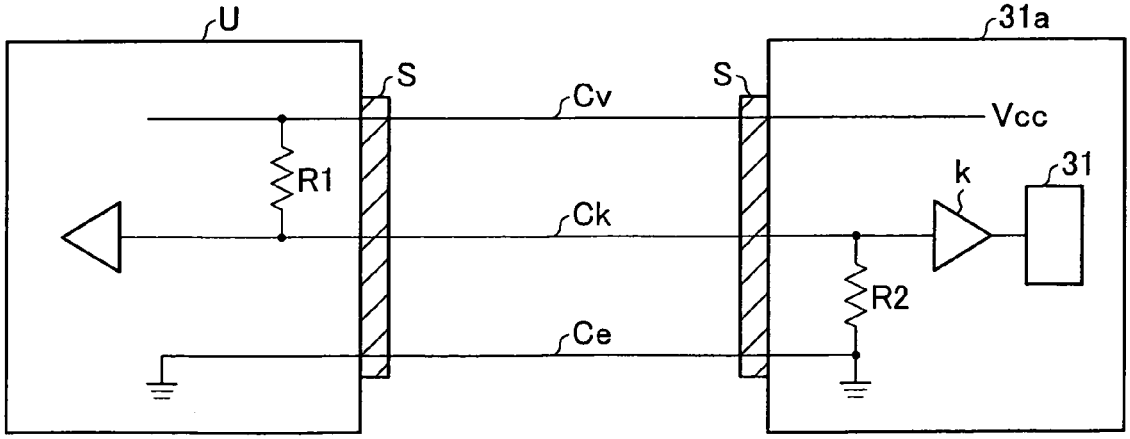
FIG. 5 is an explanatory view illustrating the structure of the connection detecting circuit in the connection checking system provided in the printer device of FIG. 1.

This terminal k also functions as an input terminal for receiving signals from the unit U under the control of the control section 31 as shown in FIG. 5.

The terminal k is an input/output terminal (input/output port) which can be functioned both as an output terminal and an input terminal.

The foregoing input/output terminal is described in the non-patent document (NIPPON DENNKI 78KO/KE1 user's manual (U162228 JJVoUDoo) published on January, 2003, pages 36 to 49).

The signal cable (first signal cable) Ck is a cable corresponding to the terminal k of the cable with connectors CB (the cable for transmitting the control signal as outputted from the terminal k to the side of the unit U).

The power cable Cv of the cable with connectors CB is provided for supplying power from the control substrate 31*a* to the unit U. Here, a voltage value of the power supply is set to Vcc.

The ground cable Ce serves as a ground wire in the cable with connectors CB.

The resistance R1 (first resistance) connects the signal cable Ck and the power cable Cv in the unit U. The resistance value of the resistance R1 is set to 10 kΩ.

The resistance R2 (second resistance) connects the signal cable Ck and the ground cable Ce in the control substrate 31*a*. The resistance value of the resistance R2 is set to 100 kΩ.

Therefore, according to the foregoing connection detecting circuit, when the cable with connectors CB is connected to the control substrate 31*a* and the unit U, the power cable Cv is connected to the signal cable Ck via the resistance R1 in the unit U. Furthermore, the signal cable Ck is connected to the ground cable Ce via the resistance R2 in the control substrate 31*a*.

Therefore, the detection voltage Vk obtained from the terminal k when the cable with connectors is connected to the control substrate 31*a* is defined by the following formula:

$$Vk=Vcc\cdot R2/(R1+R2)=Vh.$$

On the other hand, when the cable with connectors CB is not connected to the control substrate 31*a* or the unit U (detached from the unit U, the power cable Cv and the signal cable Ck are not connected. Therefore, the detection voltage V of the terminal k becomes an earth potential Ve (OV).

Next, operations of the connection checking system of the present embodiment will be explained.

The control section 31 periodically switches the terminal k to the input terminal. The control section 31 then obtains the detection voltage Vk from the terminal k as it is switched to the input terminal.

The control section 31 then determines if the detection voltage Vk is Vh or Ve.

When the detection voltage Vk is Vh, the control section 31 determines that the cable with connectors CB is connected to the unit U and the control substrate 31*a*. On the other hand, when the detection voltage. Vk is Ve, the control section 31 determines that the cable with connectors CB is detached from at least either one of the unit U and the control substrate 31*a*.

As described, in the connection checking system of the present embodiment, when the cable with connectors CB is connected to the unit U, the signal cable Ck is connected to the power cable Cv in the unit U via the resistance R1.

Therefore, when the cable with connectors CB is connected to the control substrate 31*a* and the unit U, the power-supply voltage Vcc is applied to the terminal K via the signal cable Ck as being dropped by the resistance R1.

In this case, the voltage to be applied to terminal k (dropped voltage) is determined based on the power-supply voltage Vcc and the resistance R1.

The connection checking system of the present embodiment is provided with the control section 31 which detects the connected state of the cable with connectors CB based on the voltage applied to terminal k.

Namely, the control section 31 determines that the cable with connectors CB is connected to the unit U and the control substrate 31*a* (the unit U is connected to the control substrate 31*a*) when a dropped voltage is applied to the terminal k via the signal cable Ck.

On the other hand, when the dropped voltage is not applied to the terminal k, the control section 31 determines that the cable with connectors CB is disconnected from at least either one of the unit U or the control substrate 31*a* (the unit U is not connected to the control substrate 31*a*).

As described, according to the connection checking system of the present embodiment, by only determining (measuring) the voltage applied to the terminal k in the control substrate 31*a*, the connected state of the cable with connectors CB with respect to the control substrate 31*a* and the unit U can be determined. It is therefore possible to determine the connected state of the cable with connectors CB with ease.

According to the connection checking system of the present embodiment, the connected state can be determined using the conventional cable with connectors CB or the power cable Cv, the signal cable Ck and the terminal k provided in the control substrate 31*a*.

Namely, the connection checking system of the present embodiment does not require the power supply or the terminal be dedicated for checking the connected state. Therefore, the connection checking system of the present embodiment can be manufactured at low costs.

According to the connection checking system of the present embodiment, the terminal k is made up of an input/output terminal which can function as an output terminal and an input terminal.

It is therefore possible for the control section 31 to directly obtain a voltage value as inputted to the terminal k. Therefore, an input terminal dedicated to obtain the voltage value applied to the terminal k is not needed. As a result, the manufacturing cost for the connection checking system of the present embodiment can be still reduced.

The connection checking system of the present embodiment adopts the ground cable Ce generally provided in the cable with connectors CB.

Namely, when the cable with connectors CB is connected to the control substrate 31*a*, the ground cable Ce is connected to the signal cable Ck via the resistance R2 on the upstream side of the terminal k in the control substrate 31*a*.

Therefore, according to the connection checking system of the present embodiment, when the cable with connectors CB is connected to the control substrate 31*a* and the unit U, the voltage Vh (the dropped power-supply voltage Vcc) as defined by the following formula is applied to the terminal k:

$$Vh=Vcc\cdot R2/(R1+R2).$$

On the other hand, when the cable with connectors CB is disconnected from at least either one of the control substrate 31*a* and the unit U, the terminal k is set to a ground potential Ve.

As a result, the control section 31 can determine the connected state of the cable with connectors CB with ease.

It is preferable that the connection checking system of the present embodiment be arranged such that the resistance R1 and the resistance R2 satisfy the condition of:

$$R2/R1>1.$$

It is more preferable that the connection checking system of the present embodiment be arranged such that the resistance R1 and the resistance R2 satisfy the condition of:

$$R2/R1>3.$$

Namely, under the condition of R2/R1<1, Vh becomes smaller than Vcc/2, and the difference from the ground potential Ve becomes small. A problem therefore arises in that an error is likely to occur in the determination due to the contamination by noise.

On the other hand, under the condition of R2/R1>3, Vh becomes 3/4 Vcc or larger than Vcc/2, and the difference between Vh and the ground potential Ve can be made larger. As a result, it is possible to ensure sufficient noise margin.

According to the present embodiment, the unit and the control substrate 31*a* are connected by the cable with connectors CB, and the connected state of the cable with connectors CB is determined by the connection checking system of the present embodiment.

However, the present invention is not intended to be limited to the foregoing structure, and it may be arranged so as to connect the unit and the control substrate 31*a* by other connecting member than the cable with connectors CB, and to detect the connected state of the connecting member by the connection checking system of the present embodiment.

Figure 6:
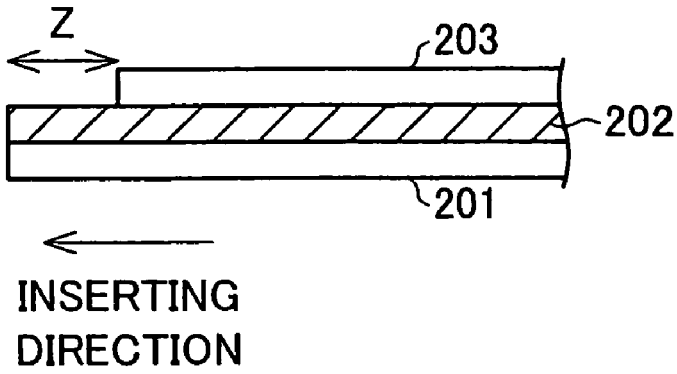
FIG. 6 is an explanatory view illustrating the schematic structures of the FPC and the FFC.
Figure 7:
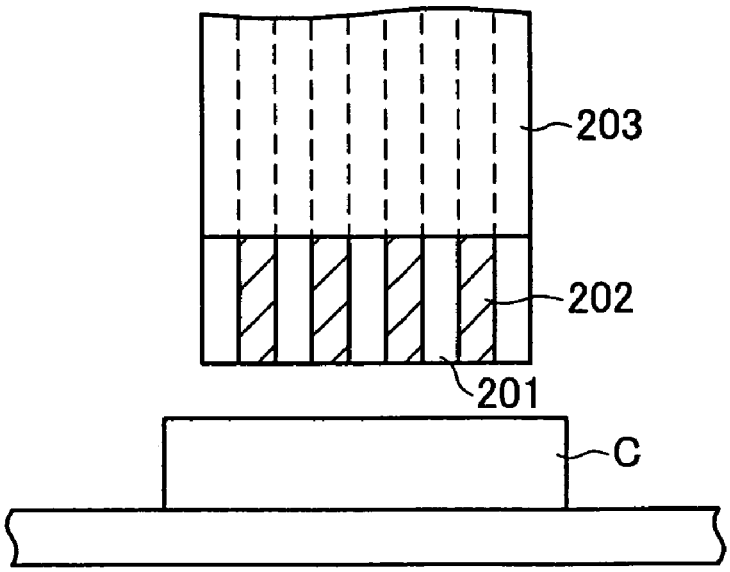
FIG. 7 is an explanatory view illustrating the schematic structures of the FPC and the FFC.

Non-limited examples of such connecting member include: a flexible print circuit (FPC), and a flexible flat cable (FFC). FIGS. 6 and 7 are explanatory views illustrating the schematic structures of the FPC and the FFC.

As illustrated in FIGS. 6 and 7, these cables have the laminated structure of a base film 201, a wiring 202 and a cover lay 203.

Each of these cables is arranged such that the cover lay 203 of the end part Z (contact part) is peeled to expose the wiring 202 to be connected to the control substrate 31*a* and the unit. Then, this end part Z is inserted directly into the connector C of the control substrate 31*a* or the unit.

With the foregoing structure of adopting the FPC and the FFC as the connecting member, it is still possible to realize the connection checking system for the printer device of the present embodiment.

Specifically, one of the input/output terminals of the control substrate 31*a*, which output control signals to one of the single output lines of the wiring 202 is adopted as the terminal k. Then, the output signal line corresponding to the terminal k is adopted as the signal cable Ck.

Further, the power supply line and the ground line of the wiring 202 are adopted as the ground cable Ce and the power cable Cv, and these lines are connected to the signal cable Ck via the resistances R1 and R2 (see FIG. 4). As a result, the connection checking system of the present embodiment as shown in FIG. 4 can be realized.

Incidentally, the connection checking system of the printer device of the present embodiment is also applicable to the structure wherein the cable with connectors CB or other connecting members are not adopted.

For example, the control substrate 31*a* may be provided with a sub substrate (print substrate such as expansion memory, etc.) to be directly attached thereto. Such sub substrate has a connector (wiring pattern) on the side of the substrate, and it may be arranged so as to insert this connector to the slot connector (not shown) of the control substrate 31*a*.

With this structure, one of the input/output terminals in the control substrate 31*a*, which outputs a control signal to one of the signal output lines in the slot connector (or the connector of the sub substrate) of the control substrate 31*a* is adopted as the terminal k. Then, the output signal line corresponding to the terminal k is adopted as the signal cable Ck.

Further, in the connector of the sub substrate, the power supply line Cv and the signal cable Ck are connected via the resistance R1, and in the slot connector, the ground line and the signal cable Ck are connected with the resistance R2. As a result, the connection checking system of FIG. 4 of the present embodiment can be realized.

According to the present embodiment, the cable with connectors CB is provided with connectors CN at both ends, and is detachable from both the control substrate 31*a* and the unit.

However, the present invention is not intended to be limited to the foregoing structure, and it may be arranged, for example, such that one of the ends of the cable with connectors CB is fixed to the unit U so as not to be detachable, for example, by solder mounting.

In the present embodiment, it is determined if the cable with connectors CB, or other connecting member is connected to the control substrate 31*a* and the unit U by the connection checking system of the present embodiment.

However, in the case of adopting an optional device (external device which is separately provided from the printer device of the present embodiment) to be connected to the connector of the control substrate 31*a*, the connection checking system of the present embodiment may be adopted to check if such optional device is mounted (connected) properly.

With this structure, when mounting the optional device to the control substrate 31*a*, the cable with connectors CB of FIG. 3 is adopted. Then, when the control section 31 determines that the detection voltage Vk of the terminal k corresponding to this optional device is Ve, it is determined that this optional device is not connected.

Non-limited examples of these optional devices include a post-processing apparatus after printing, such as a stapling process, etc.

Such optional device is generally set in the printer device not in the manufacturing process of the printer device but after purchasing the printer device, by a user, a manufacture, a service person, etc. Therefore, an installation error of the optional device is likely to occur. In response, by adopting the connection checking system of the present embodiment in the foregoing printer device with the optional device, such an installation error can be detected with ease.

Incidentally, the connection checking system of the present embodiment is arranged such that the ground cable Ce and the first signal cable Ck are connected via the resistance R2 in the control substrate 31*a*.

However, even without such ground cable Ce, a voltage applied to the terminal k from the first cable Ck varies depending on whether or not the cable with connectors CB is connected to both of the unit U and the control substrate 31*a*. Therefore, even without using such cable Ce, it is still possible for the control section 31 to check the connected state of the cable with connectors CB.

According to the present embodiment, the control substrate 31*a* and the unit in the printer device of the present embodiment are connected by the connecting member such as the cable with connectors CB, etc., and the connected state is checked by the connection checking system of the present embodiment.

The connection checking system of the present invention for checking the connected state of the connecting member can be applied to other electronic device as long as a terminal (input/output terminal) which can function both as the input terminal and the output terminal, is provided in the control substrate 31*a*.

The connection checking system of the present embodiment adopts the terminal k which serves as the input/output terminal for sending the control signal to the unit U connected to the cable with connectors C to obtain a detection voltage Vk.

However, the connection checking system of the present embodiment can be realized even in the structure without the terminal k.

Figure 8:
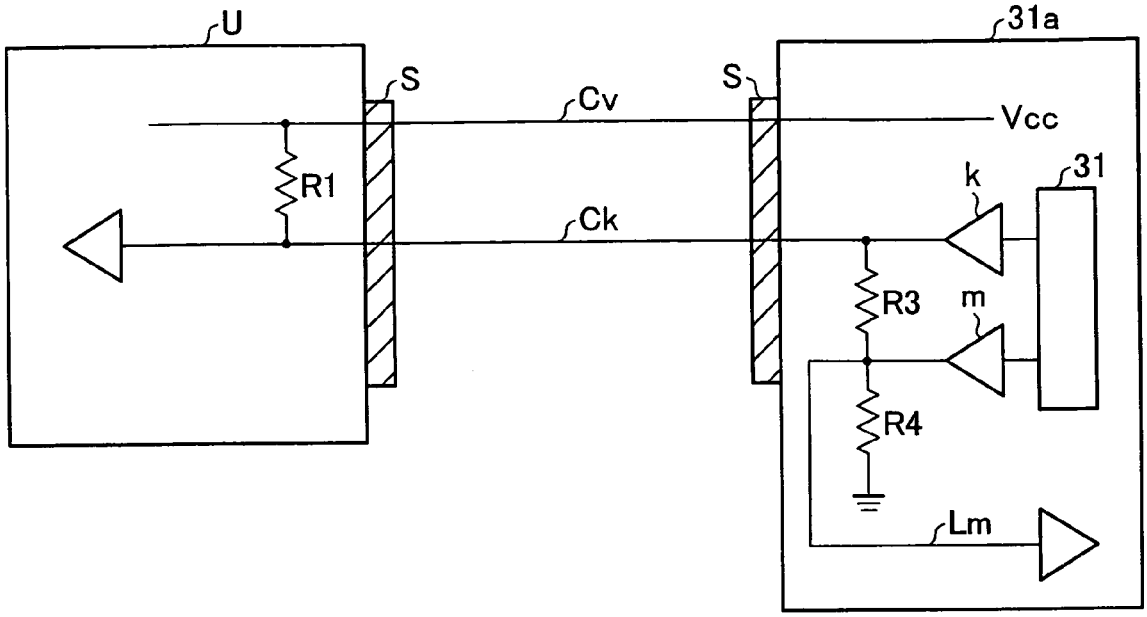
FIG. 8 is an explanatory view illustrating the structure of the connection detecting circuit applicable to the connection checking system provided in the printer device of FIG. 1.
Figure 9:
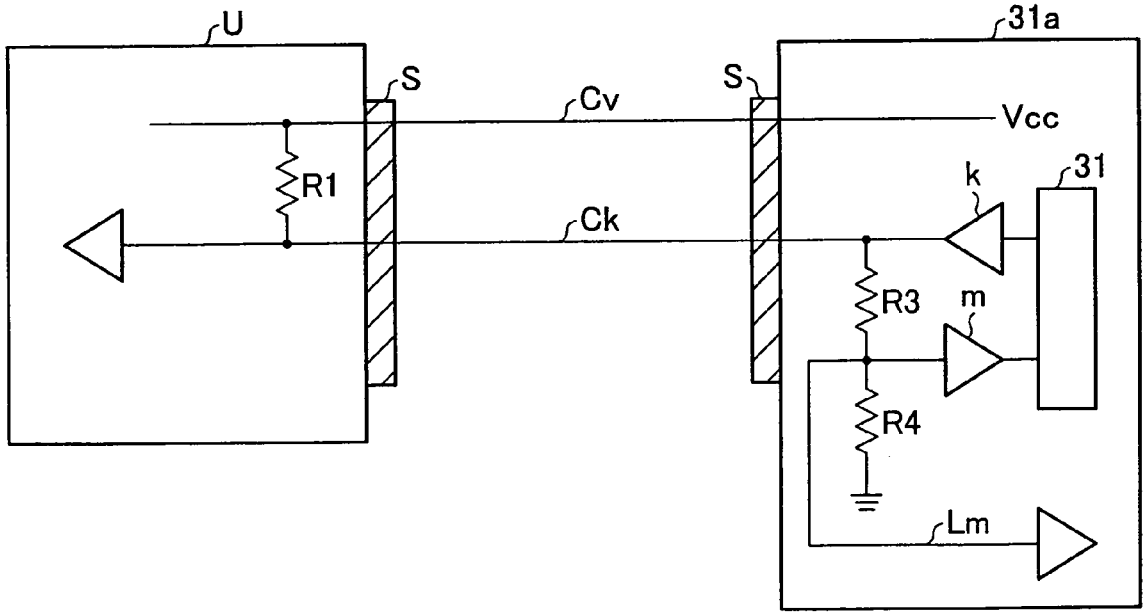
FIG. 9 is an explanatory view illustrating the structure of the connection detecting circuit applicable to the connection checking system provided in the printer device of FIG. 1.

In the foregoing structure, the connection checking system of the present embodiment can be arranged, for example, as shown in FIGS. 8 and 9.

In this structure, in addition to the terminal k, another terminal (second terminal) in the control substrate 31*a* is adopted. In this structure, the terminal k serves as a general output terminal and the terminal m is connected to the terminal k via the resistance R3 (third resistance).

This terminal m is provided not for sending a control signal to the unit U like the terminal k, but for outputting a control signal (power supply signal, etc.) to another device (LED, for example) in the control substrate 31*a* via the line Lm.

This terminal m can function also as an input terminal for inputting a signal from the side of the unit U as shown in FIG. 9 under the control of the control section 31. Namely, the terminal m is an input/output terminal, which can function both as an output terminal and an input terminal.

In the structure of FIG. 8, the line Lm (second signal cable) of the terminal m is connected to the signal cable Ck and the resistance R3. Further, the line Lm is connected to ground via the resistance R4 (fourth resistance).

As in the structure of FIG. 4, the power cable Cv of the cable with connectors CB is connected to the signal cable Ck via the resistance R1 in the unit U.

Therefore, according to the foregoing connection detecting circuit, in the state where the cable with connectors CB is connected to the control substrate 31*a* and the unit U, the power cable Cv is connected to the signal cable Ck via the resistance R1 in the unit U.

Furthermore, the signal cable Ck is connected to the line Lm via the resistance R3 in the control substrate 31*a*.

Therefore, in this case, if the effect of the output signal onto the terminal k is not considered, a detection voltage Vm as defined by the following formula can be obtained from the terminal m:

$$Vm=Vcc\cdot R4/(R1+R3+R4)=Vh.$$

On the other hand, when the cable with connectors CB is not connected to the control substrate 31*a* or the unit U (detached from the control substrate 31*a* or the unit U), the power cable Cv and the signal cable Ck (line Lm) are not connected. Therefore, the detection voltage V of the terminal m is a ground potential Ve (OV).

According to the foregoing structure, the control section 31 periodically sets the output terminal of the terminal k in the high impedance state (the output signal from the terminal k is stopped), and switches the terminal m to the input terminal. Then, from the terminal m as switched to the input terminal, a detection voltage Vm is obtained periodically.

Thereafter, the control section 31 determines if the detection voltage Vm is Vh or Ve.

When the detection voltage Vm is Vh, the control section 31 determines that the cable with connectors CB is connected to the unit U and the control substrate 31*a*. On the other hand, when the detection voltage Vm is Ve, the control section 31 determines that the cable with connectors CB is detached from either the unit U or the control substrate 31*a*.

As described, even with the structure wherein none of the terminals for transmitting signals to the cable with connectors CB are input/output terminals, as long as an input/output terminal is provided in the control substrate 31*a*, it is still possible to realize the connection checking system of the present embodiment.

In the structures shown in FIGS. 8 and 9, the output terminal of the terminal k can be set in the high impedance state, for example, in the following manner.

Figure 10:
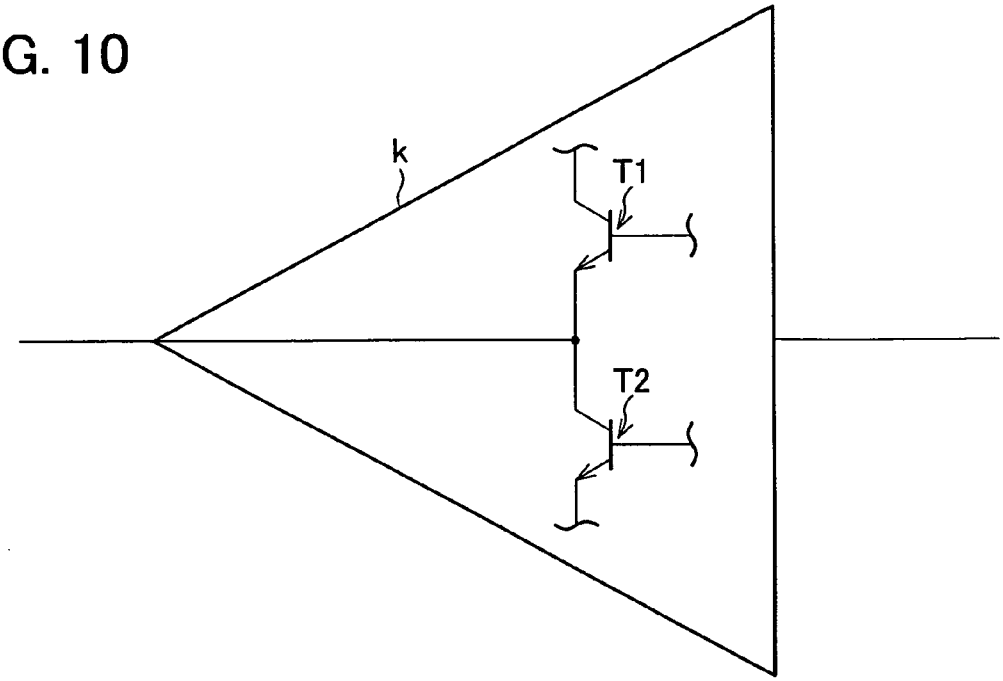
FIG. 10 is an explanatory view illustrating the structure around the terminal k shown in FIGS. 8 and 9.

Namely, in the case where the output terminal of the terminal k is constituted by connecting two transistors T1 and T2 in series as shown in FIG. 10, the terminal k can be set in the high impedance state by setting these transistors T1 and T2 in the OFF state.

With the foregoing structure, it is preferable that the respective resistance values R1, R3 and R4 satisfy the condition of:

$$R4/(R1+R3)>1.$$

It is more preferable that the respective resistance values R1, R3 and R4 satisfy the condition of:

$$R4/(R1+R3)\geqq 3.$$

Namely, under the condition of R4/(R1+R3)≦1, Vh becomes smaller than Vcc/2, and the difference from the ground potential becomes small. A problem therefore arises in that an error is likely to occur in the determination due to the contamination by noise.

On the other hand, under the condition of R4/(R1+R3)≧3, Vh becomes 4/5 Vcc or larger, and the difference between Vh and the ground potential can be made larger. As a result, it is possible to ensure sufficient noise margin.

In the foregoing structure, the terminal m is provided not for sending a control signal to the unit U, but for outputting a control signal to another device (such as LED, etc.) in the control substrate 31*a* via the line Lm (LED, for example). However, the present invention is not intended to be limited to the foregoing structure, and the terminal m may be used for sending the control signal to the unit U (or other unit) like the terminal k.

In the structures of FIG. 8 and FIG. 9, the line Lm is connected to ground via the resistance R4. However, without such connection to ground, it is still possible for the control section 31 to determine the connected state of the cable with connectors CB because depending on whether or not the cable with connectors CB is connected to the unit U and the control substrate 31*a*, a voltage to be applied from the first cable Ck to the terminal k (terminal m) varies.

The present embodiment is arranged such that the power cable Cv and the signal cable Ck are connected via the resistance R1 in the unit U. However, the present invention is not intended to be limited to the above, and, for example, the structure wherein the power cable Cv and the signal cable Ck are connected in the control substrate 31*a* may be adopted.

Figure 11:
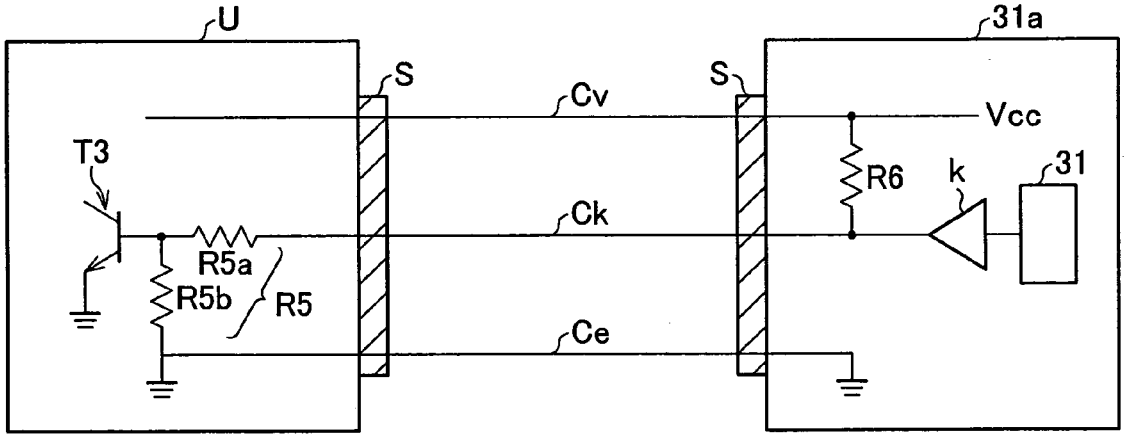
FIG. 11 is an explanatory view illustrating the structure of the connection detecting circuit applicable to the connection checking system provided in the printer device of FIG. 1.
Figure 12:
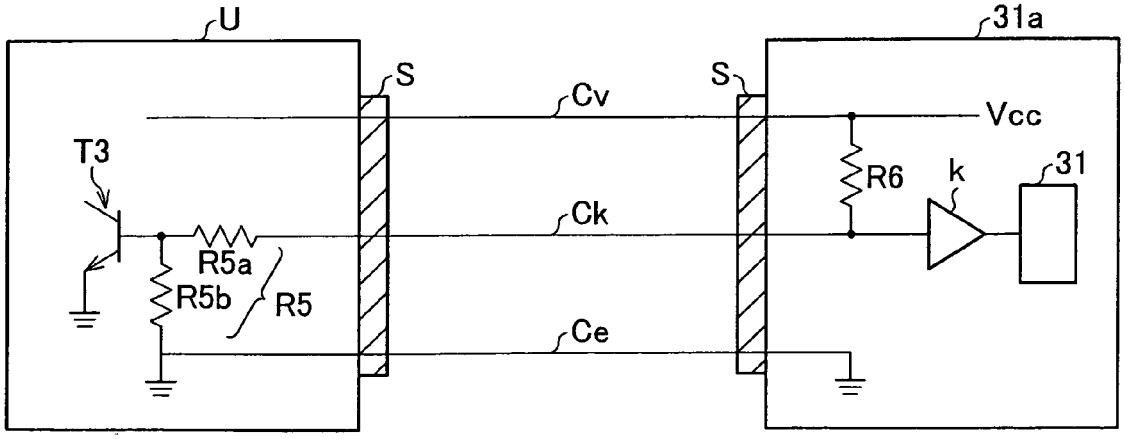
FIG. 12 is an explanatory view illustrating the structure of the connection detecting circuit applicable to the connection checking system provided in the printer device of FIG. 1.

FIG. 11 and FIG. 12 are explanatory views showing the foregoing structure.

As illustrated in these figures, the connection checking system of the present embodiment is made up of the terminal k, the power cable Cv, the signal cable Ck, the ground cable Ce, and resistances K5 and R6.

The power cable Cv is then connected to the signal cable Ck via the resistance R6 (the sixth resistance) within the control substrate 31*a*.

Incidentally, the signal cable Ck is connected to the ground cable Ce within the unit U via the resistance R5 (R5*a*, R5*b*; the fifth resistance).

Therefore, in this connection detecting circuit, in the state where the cable with connectors CB is connected to the control substrate 31*a* and the unit U, a detection voltage Vk as defined by the following formula is received.

Vk=(Vcc−Vbe)·R5*a*/(R5*a*+R6)+Vbe=V1, wherein Vbe is a base-emitter voltage of the transistor T3 (around 0.7 V).

On the other hand, when in the state where the cable with connectors CB is not connected to (detached from) the control substrate 31*a* or the unit U, the signal cable Ck and the ground cable Ce are not connected.

Therefore, the detection voltage Vk of the terminal k becomes the power-supply voltage Vcc.

As described, according to the foregoing structure, in the state where the cable with connectors CB is connected to the control substrate 31*a* and the unit U, the detection voltage Vk becomes a low voltage (V1). On the other hand, in the state where the cable with connectors CB is not connected, the detection voltage Vk becomes a high voltage (Vcc).

In the structures shown in FIG. 11 and FIG. 12, signal cable Ck is connected to the base of the NPN transistor T3 within the unit U.

Therefore, in the state where the cable with connectors CB is connected to the control substrate 31*a* and the unit U, a collector current flows in the transistor T3. Therefore, it is possible to determine the connected state of the cable with connectors CB also on the side of the unit U.

It is preferable that the printer device of the present embodiment be arranged such that when the operating section 32 receives an instruction in relation to the unit which is not connected to the control substrate 31*a* by the cable with connectors CB, the control section 31 controls the operating section 32 to display a message indicative of that the unit U is not connected.

In this way, the user can recognize with ease that the unit U to be used is not connected to the printer device of the present embodiment (the unit U is not ready to use).

To be more convenient for the user, it is also preferable that the foregoing printer device of the present embodiment be arranged such that even when any of the units U is not connected properly, other units U which are properly connected can be used.

Incidentally, the electro-photographic device such as a printer device is generally provided with a large number of units. Therefore, by adopting the connection checking system of the present embodiment to the electro-photographic device, the connected state of each unit can be recognized with ease, and a significant improvement in operability can be realized.

In the structure of FIG. 4, a constant voltage Vcc is applied to the power cable Cv. However, the present embodiment is not intended to be limited to this structure, and for example, for the power supply for supplying power by the power cable Cv, a constant current power supply may be adopted.

In the present embodiment, as illustrated in FIG. 4, for example, the power cable Cv is connected to the signal cable Ck via the resistance R1 (first resistance) in the unit U. More specifically, the two terminals in the pin connectors S of the unit U connected to the power cable Cv and the signal cable Ck are connected via the resistance R1 in the unit U.

In the foregoing structure, all the processes in the printer device of the present embodiment including the process of determining the connected state of the cable with connectors CB, etc., are controlled by the control section 31. However, the present invention is not intended to be limited to the foregoing structure, and it may be arranged so as to store the program for executing the foregoing processes in a recording medium and to adopt an information processing device (computer) which can read out the program from the recording medium in replace of the control section 31.

In this structure, an arithmetic unit (CPU or MPU) of the information processing device reads out the program from the recording medium, and executes the program.

Therefore, it can be said that the program itself executes the processes.

Non-limited examples of the information processing device include, an expansion board, an expansion unit to be mounted in the computer other than generally used computers (a work station, a personal computer, etc.).

The foregoing program includes program codes (an executing program, an intermediate code program, a source program, etc.) of the software which realizes the processes. This program may be used alone or in combination with other program (OS, etc.). Here, it may be arranged that the program is once stored in a memory (RAM, etc.) in the device after being read out from the recording medium and is then executed.

The recording medium for storing the program may be arranged so as to be detachable from the information processing apparatus with ease, or fixed (mounted) to the device, or connected to the device as an external memory device.

Non-limited examples of the recording medium include: a magnetic tape such as a video tape, a cassette tape, etc., a magnetic disk such as a floppy (registered mark) disk, a hard disk, etc., an optical disk (optical magnetic disk) such as CD-RON, MO, MD, DVD, CD-R, etc., a memory card such as an IC card, an optical card, etc., a semiconductor memory such as a mask ROM, an EPROM, EEROM, a flash ROM, etc.

The recording medium may be connected to the information processing device via network (intranet, internet, etc.). In this case, the information processing device obtains the program by downloading the program via the network. Namely, the program may be obtained via a transmission medium (storing the program in the floating state) such as the wireless or fixed line network. Incidentally, it is preferable that the program for downloading be stored beforehand in the device (on the transmission side or the receiving side).

In the foregoing connection checking system of the present embodiment, the connecting member which connects the control substrate 31*a* and the unit may be arranged so that the wiring for the connection provided at least one end of the connection cable, is made up of a plurality of wires or a bundle of wiring. Incidentally, the connecting member includes a flexible print circuit (FPC), a flexible flat cable (FFC), a substrate amounted to the connector of the main substrate (an expansion memory substrate to be mounted to the connector of the mother board of a personal computer, etc.), in which an end part for connection of the wiring is exposed to be directly inserted into the connector provided on the side of the substrate. The connecting member may be arranged so as to connect substrates directly without cable.

It is preferable that the foregoing connection checking system of the present invention not be provided separately from the printer but be stored in the printer device of the present embodiment.

The present invention may be realized by a self-checking circuit for checking if the connector is fitted. In the connection checking system of Japanese Unexamined Utility Model Publication 8-001388/1996, a switch is provided at the connection point of the ladder resistance, and a partial pressure of each ladder resistance is varied to be inputted to the A/D converter, to detect the state of the switch. Incidentally, it can be said that the connection checking system of Japanese Unexamined Utility Model Publication 8-001388/1996 is arranged so as to detect the installation based on the conduction between the first detection terminal of the connector and the short-circuit elastic contact terminal.

As described, the connection checking system of the present invention for checking a connected state of a connecting member which connects an electronic device and a unit, is characterized by comprising:

a connecting member which includes a power supply cable for supplying a power supply voltage from an electronic device to a unit, and a first signal cable for sending a control signal as outputted from a first signal terminal of the electronic device to the unit; and a control section which makes a determination on the connected state of the connecting member, wherein when the connecting member is connected to the unit, the first signal cable is connected to the power supply cable via a first resistance in the unit; and the control section makes a determination on the connected state of the connecting member based on a voltage applied to the first signal terminal.

The connection checking system of the present embodiment is provided for determining the connected state of the connecting member which connects the printer device or other electronic device and each of the units provided in the electronic device (i.e., the connected state of the electronic device and the unit).

In the present invention, the unit is provided in the electronic device, and which provides an additional function to the electronic device. Non-limited examples of such unit include an expansion memory substrate, a key board, a monitor, a paper feeder, etc. The connecting member is provided for connecting the cable with connectors to the unit such as a harness, a FPC, etc., and the electronic device.

This connecting member includes the power supply cable and the first signal cable.

The power supply cable is provided for supplying a power supply voltage from the electronic device to the unit.

This signal cable is connected to the first signal terminal of the electronic device, and outputs a control signal as outputted from the first signal terminal to the unit.

Generally, the unit is supplied with power from the electronic device.

A control signal (an output signal from the first output terminal) as sent in the first signal cable is a signal required for controlling (driving) the unit by the electronic device. Therefore, the first signal terminal and the first signal cable adopted in the present invention are generally provided in the electronic device or the connecting member, etc.

The foregoing power supply cable, the first signal cable, and the first signal terminal are all generally provided in the electronic device, and the connecting member.

According to the connection checking system of the present embodiment, in the case where the connecting member is connected to the unit, the first signal cable is connected to the power supply cable via the first resistance in the unit.

Therefore, in the state where the connecting member is connected to the electronic device and the unit, the power-supply voltage as being dropped by the first resistance is supplied to the first signal terminal via the first signal cable.

In this case, a voltage (dropped voltage) to be applied to the first signal terminal is determined based on the power supply voltage and the first resistance value.

The connection checking system of the present embodiment is provided with the control section for determining the connected state of the connecting member based on a voltage value applied to the first signal terminal.

Namely, when the dropped voltage is applied to the first signal terminal via the first signal cable, the control section determines that the connecting member is connected to the unit and the electronic device (the unit is connected to the electronic device).

On the other hand, when a dropped voltage is not applied to the first signal terminal, the control section determines that the connecting member is not connected to at least either one of the unit and the electronic device (the unit is not connected to the electronic device).

As described, according to the connection checking system of the present embodiment, by only determining (measuring) the voltage applied to the first signal terminal in the electronic device, the connected state of the connecting member with respect to the electronic device and the unit can be determined. As a result, the connected state of the connecting member can be determined in quite simple manner.

According to the connection checking system of the present embodiment, the connected state of the connecting member is determined using the power supply cable, the first signal cable and the first signal terminal provided in the conventional connecting member, and the electronic device.

Namely, the connection checking system of the present embodiment does not require the power supply or the terminal be dedicated for checking the connected state. Therefore, the connection checking system of the present embodiment can be manufactured at low costs.

In the connection checking system of the present embodiment, it is preferable that the first signal terminal be made up of an input/output terminal which can function both as the output terminal and the input terminal.

It is therefore possible for the control section to directly obtain a voltage value as inputted to the first signal terminal from this terminal. Therefore, an input terminal dedicated to obtain the voltage value applied to the first signal terminal is not needed. As a result, the manufacturing cost for the connection checking system of the present embodiment can be still reduced.

In this structure, it is preferable to use the ground cable generally provided in the connecting member. Specifically, it is preferably arranged such that when the connecting member is connected to the electronic device, the ground cable is connected to the first signal cable via the second resistance on the upstream side of the first signal terminal in the electronic device.

With this structure, when the connecting member is connected to the electronic device and the unit, the voltage Vh (dropped power-supply voltage) as defined by the following formula is applied to the terminal k:

$Vh=Vcc\cdot R2/(R1+R2)$, wherein R1 is a resistance value of the first resistance, and R2 is a resistance value of the second resistance.

On the other hand, in the state where the connecting member is not connected at least either one of the electronic device, and the unit, the first signal terminal is at a ground potential.

As a result, the control section can determine the connected state of the connecting member with ease.

With this structure, it is preferable that the resistance value R1 and the resistance value R2 satisfy the condition of:

$$R2/R1>1.$$

It is more preferable that the resistance value R1 and the resistance value R2 satisfy the condition of:

$$R2/R1\geqq 3.$$

Namely, under the condition of $R2/R1\leqq 1$, Vh becomes smaller than Vcc/2, and the difference from the ground potential Ve becomes small. A problem therefore arises in that an error is likely to occur in the determination due to the contamination by noise.

On the other hand, under the condition of $R2/R1\geqq 3$, Vh becomes 3/4 Vcc or larger than Vcc/2, and the difference between Vh and the ground potential Ve can be made larger. As a result, it is possible to ensure sufficient noise margin.

Incidentally, in the connection checking system of the present invention, the first signal terminal is not necessarily an input/output terminal. When adopting for the first signal terminal, the terminal which functions only as an output terminal, another signal terminal (second signal terminal) in the electronic device, which can be functioned as the electronic device may be adopted.

This second signal terminal is provided for outputting a signal, as outputted from the control section, to another member in the electronic device via the second signal cable in the electronic device.

According to the foregoing structure, when the connecting member is connected to the electronic device, the second signal cable is connected to the first signal cable in the electronic device.

The control section then determines the connected state of the connecting member based on a voltage of the first signal terminal, as inputted via the second signal terminal.

The foregoing second signal terminal which outputs/inputs signals in the electronic device is also generally provided in the electronic device as in the first signal terminal. Therefore, when adopting the foregoing structure of the connection checking system of the present invention, a problem of increasing manufacturing costs will not be raised.

In the foregoing structure of adopting the second signal terminal, it is preferable that the control section control the output terminal of the first signal terminal to be set in the high impedance state when determining the connected state of the connecting member. In this way, it is possible to prevent a voltage to be applied to the first signal terminal from being affected by the control signal to be outputted from the first signal terminal to the unit. As a result, an accurate determination on the connected state of the connecting member can be made by the control section.

When adopting the second signal terminal, it is also preferable that the second signal cable be connected to ground via the resistance.

Namely, it is preferably arranged such that when the connecting member is connected to the electronic device, the first signal cable and the second signal cable are connected via the fourth resistance in the electronic device, and the second signal cable is connected to ground via the fifth resistance.

According to the foregoing structure, in the state where the connecting member is connected to the electronic device and the unit, a voltage Vh, as defined by the following formula, is applied to the first signal terminal:

$$Vh=Vcc\cdot R4/(R1+R3+R4),$$

wherein Vcc is the power supply voltage, R1 is a resistance value of the first resistance, R3 is a resistance value of the third resistance, and R4 is a resistance value of the fourth resistance.

On the other hand, when the connecting member is not connected to at least one of the electronic device and the unit, the first signal terminal is set to a ground potential.

It is therefore possible for the control section to determine the connected state of the connecting member in a more simple manner.

With the foregoing structure, it is preferable that the respective resistance values R1, R3 and R4 satisfy the condition of:

$$R4/(R1+R3)\geqq 1.$$

It is more preferable that the respective resistance values R1, R3 and R4 satisfy the condition of:

$$R4/(R1+R3)\geqq 3.$$

Namely, under the condition of R4 (R1+R3)≧1, Vh becomes smaller than Vcc/2, and the difference from the ground potential becomes small. A problem therefore arises in that an error is likely to occur in the determination due to the contamination by noise.

On the other hand, under the condition of R4/(R1+R3)>3, Vh becomes 4/5 Vcc or larger, and the difference between Vh and the ground potential can be made larger. As a result, it is possible to ensure sufficient noise margin.

According to the foregoing preferred embodiment, in the state where the connecting member is connected to the unit and the electronic device, the first signal cable and the power supply cable are connected in the unit.

However, the present invention is not intended to be limited to the above structure. For example, the structure wherein the first signal cable and the power supply cable are connected in the electronic device may be adopted.

In this structure, the connecting member is arranged so as to include the power supply cable, the first signal cable and the ground cable. When the connecting member is connected to the unit and the electronic device, the first signal cable and the ground cable are connected in the unit via the fifth resistance in the unit, and the first signal cable and the power supply cable are connected via the sixth resistance in the electronic device.

Then, the control section determines the connected state of the connecting member based on the voltage applied to the first signal terminal in the same manner as the former example.

In this structure, the voltage as defined by the following formula is applied to the first signal terminal:

$$Vh=Vcc\cdot R5/(R5+R6),$$

wherein Vcc is the power supply voltage, R5 is the resistance value of the fifth resistance and R6 is a resistance value of the sixth resistance.

On the other hand, in the state where the connecting member is not connected to at least either one of the electronic device and the unit, the first signal terminal becomes ground potential.

The foregoing structure therefore permits the connected state of the connecting member to be checked by the control section with ease.

Incidentally, the connection checking system of the present embodiment may be arranged such that an external device which is separately provided from the electronic device is recognized as a unit, and the connected state of this external device and the electronic device is determined.

The foregoing external device is generally referred to as an optional unit (optional device). For example, in the case where the electronic device is a printer device (a part of the printer device (control substrate, etc.)), the optional unit can be a post processing apparatus after copying (stapling process, etc.).

Such an optional device is generally set in the electronic device not in the manufacturing process of the printer device but after purchasing the electronic device, by a user, a manufacture, a service person, etc. Therefore, an installation error of the optional device is likely to occur.

In response, by adopting the connection checking system of the present invention in the foregoing electronic device to which the optional device is connected, such an installation error can be detected with ease.

Incidentally, in the case where the connection checking system of the present invention is adopted in the printer device, it is preferable that an operation section be provided for receiving instructions from the user and displaying messages to the user.

For the foregoing connection checking system of the present embodiment, it is preferable that the control section be arranged so as to display a message "the unit is not connected" via the control section when the control section of the printer device receives an instruction regarding the unit which is not connected to the electronic device by the connecting member.

In this way, the user can immediately recognize that the unit to be used is not connected to the printer device (the target unit is not ready to use).

To be more convenient for the user, it is also preferable that the foregoing printer device be arranged such that even when any of the units is not connected properly, other units which are properly connected can be used.

Incidentally, the electro-photographic device such as a printer device, is generally provided with a large number of units. Therefore, by adopting the connection checking system of the present embodiment to the electron photographic device, the connected state of each unit can be recognized with ease, and a significant improvement in operability can be realized.

The connecting checking method of the present invention for checking a connected state of a connecting member which connects an electronic device and a unit, wherein:

a connecting member includes a power supply cable for supplying a power supply voltage from an electronic device to a unit, and a first signal cable for sending a control signal as outputted from a first signal terminal of the electronic device to the unit; and when the connecting member is connected to the unit, the first signal cable is connected to the power supply cable via a first resistance in the unit, the method comprising the step of determining a connected state of the connecting member based on a voltage value applied to the first signal terminal.

The foregoing connection checking method is adopted in the connection checking system of the present invention. According to the foregoing connection checking method, it is possible to determine the connected state of the connecting member with respect to the electric device and the unit with ease, by only determining (measuring) a voltage applied to the first signal terminal in the electronic device. As a result, the connected state of the connecting member can be determined in quite simple manner.

According to the connection checking method of the present invention, the connected state is determined using the conventional connecting member or the power supply cable, the first signal cable and the first signal terminal provided in the conventional electronic device.

Namely, the connection checking method of the present embodiment does not require the power supply or the terminal dedicated for checking the connected state. Therefore, the connection checking system of the present embodiment can be manufactured at low costs.

The connection checking program of the present invention is arranged so as to make the computer connected to the electronic device execute the determination process of the connection checking method.

The connection checking program of the present invention is a program which makes the computer connected to the electronic device function as the control section of the connection checking system of the present embodiment.

By reading the program in the generally used computer of the electronic device (or the computer connected to the electronic device), the determination process in the connection checking method of the present invention (or the process by the control section in the connection checking system of the present embodiment) can be realized by the computer.

Further, by storing the program in the computer readable recording medium, the program can be stored or distributed in the market.

As described, the connection checking system of the present invention for checking a connected state of a connecting member which connects an electronic device and a unit, is characterized by including:

a connecting member which includes a power supply cable for supplying a power supply voltage from an electronic device to a unit, and a first signal cable for sending a control signal as outputted from a first signal terminal of the electronic device to the unit; and a control section which makes a determination on the connected state of the connecting member, wherein when the connecting member is connected to the unit, the first signal cable is connected to the power supply cable via a first resistance in the unit; and the control section makes a determination on the connected state of the connecting member based on a voltage applied to the first signal terminal.

According to the foregoing structure of the connection checking system, when the connecting member is connected to the unit, the first signal cable is connected to the power supply cable via the first resistance in the unit.

Therefore, in the state where the connecting member is connected to both the electronic device and the unit, a power supply voltage is dropped by the first resistance, and the power supply voltage as dropped is applied to the first signal terminal via the first signal cable.

In this case, the voltage (dropped voltage) applied to the first signal terminal is determined based on the power supply voltage and the first resistance value.

The connection checking system of the present invention is provided with the control section for determining the connected state of the connecting member based on the voltage applied to the first signal terminal.

Namely, when the dropped voltage is applied to the first signal terminal via the first signal cable, the control section determines that the connecting member is connected to the unit and the electronic device (the unit is connected to the electronic device).

On the other hand, when the dropped voltage is not applied to the first signal terminal, the control section determines that the connecting member is not connected to at least either one of the unit or the electronic device (the unit is not connected to the electronic device).

As described, according to the connection checking system of the present invention, by only determining (measuring) the voltage applied to the first signal terminal in the electronic device, it is possible to check the connected state of the connecting member to the electronic device and the unit. As a result, the connected state of the connecting member can be checked in quite simple manner.

Furthermore, according to the foregoing connection checking system of the present embodiment, the connected state can be checked using the power supply cable, the first signal cable, the first signal terminal provided in the conventional connecting member or the electronic device.

Namely, the connection checking system of the present embodiment does not require the power supply or the terminal be dedicated for checking the connected state. Therefore, the connection checking system of the present embodiment can be manufactured at low costs.

The present invention may be defined by the following first through eleventh determination circuits, the first image forming apparatus and the first optional device. Specifically, the first determination circuit which determines the electrical connected state between the electronic device and the unit by the detachable connector is arranged such that between the two states of normal operations and the connected state determining operations, the single port (terminal k) is switched between the output port (output terminal) and the input port (input terminal) With this structure of the first determination circuit, it is possible to determine the installation of the connector with ease without increasing the number of ports and the connector terminals for the determination.

The second determination circuit having the structure of the first determination circuit is arranged such that the wiring line for the determination is connected in such a manner that current flows in the first potential (Vcc) on the side of the unit via the first resistance (R1), and flows in the second potential (GND) on the side of the electronic device via the second resistance (R2). With this structure of the second determination circuit, based on the switching of the partial pressure ratio of the voltage, the determination can be made with ease.

The third determination circuit having the structure of the second determination circuit is arranged so as to satisfy the condition of $R2/R1>1$, or more preferably satisfy the condition of $R2/R1 \geqq 3$ wherein R1 is a resistance value of the first resistance, R2 is a resistance value of the second resistance.

Under the condition of R2/R1≦1, the detection voltage becomes smaller than Vcc/2, and it is difficult to make an accurate determination. On the other hand, when satisfying the condition of R2/R1≧3, the partial pressure potential becomes 3/4 Vcc or larger or the GND potential. As a result, it is possible to ensure sufficient noise margin.

The fourth determination circuit for determining the electrical connected state by the detachable connector between the electronic device and the unit, is arranged so as to include the first port (terminal k) which outputs a signal to the unit, and a second port (terminal 3), wherein the second port (terminal m) is switched between the output port and the input port corresponding to the two states of the normal operation and the determining operation. With this structure of the fourth determination circuit, the effect of the present invention can be realized by using other input/output terminal.

The fifth determination circuit having the fourth determination circuit is arranged such that the output terminal of the first port is set in the high impedance state when carrying out the determining operation. With this structure of the fifth determination circuit, the determining operation can be prevented from being adversely affected by the output state of the first port (terminal k).

The sixth determination circuit having the structure of the fourth determination circuit is arranged such that when carrying out the determining operation, current flows from the first potential (Vcc) to the second potential (GND) via the first resistance (R1), the second resistance (R2) and the third resistance (R3). As a result, the partial pressure ratio of the voltage is switched in the connected state, and the determination can be made with ease.

The seventh determination circuit having the structure of the sixth determination circuit is arranged so as to satisfy the condition of R1/(R1+R2)>1, or more preferably satisfy the condition of R1/(R1+R2)≧3 wherein R1 is a resistance value of the first resistance, and R2 is a resistance value of the second resistance.

Under the condition of R1/(R1+R2)≦1, the detection voltage becomes smaller than Vcc/2, and it is difficult to make an accurate determination. On the other hand, under the condition of R1/(R1+R2)≧3, the partial pressure potential becomes 4/5 Vcc or larger or the GND potential. As a result, it is possible to ensure sufficient noise margin.

The eighth determination circuit having the structure of any of the first through seventh determination circuits may be arranged such that the electronic device is an image forming apparatus. The first image forming apparatus of the present invention is an image forming apparatus (electro-photographic device) as an electric device provided with any one of the first through seventh determination circuits. The electro-photographic device generally has a large number of connectors, and therefore, the effect as achieved from the present invention is particularly appreciated.

The ninth determination circuit having the structure of any one of the first to the eighth determination circuit is arranged such that the unit is an optional unit. Such optional device is generally set in the printer device not in the manufacturing process of the printer device but after purchasing the printer device, by a user, a manufacture, a service person, etc, and an installation error of the optional device is likely to occur. Therefore, the effects as achieved from the present invention can be appreciated.

Furthermore, as the optional device can be detected automatically, on the side of the main body, such manual operation for updating the main body memory is not needed for the installation of the optional device.

The tenth determination circuit having the structure of the first through ninth determination circuit may be arranged so as to make a warning or display a message when selecting the operation with regard to the unit which has not been installed. As a result, an improved operability can be realized.

The eleventh determination circuit having the structure of any one of the first through tenth determination circuit, even when it is detected that the device has not been installed, the operation irrelevant to that device can be executed. With this structure of the eleventh determination circuit, an improved operability can be realized.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A connection checking system for checking a connected state of a connecting member which connects an electronic device and a unit, comprising:

a connecting member which includes a power supply cable for supplying a power supply voltage from an electronic device to a unit, and a first signal cable for sending a control signal as outputted from a first signal terminal of said electronic device to said unit; and a control section which makes a determination on the connected state of said connecting member, wherein when said connecting member is connected to said unit, said first signal cable is connected to said power supply cable via a first resistance in said unit; and said control section makes a determination on the connected state of said connecting member based on a voltage applied to said first signal terminal.

2. The connection checking system as set forth in claim 1, wherein:

said first signal terminal is an input/output terminal which can be functioned both as an output terminal and an input terminal; and said control section makes a determination on the connected state of said connecting member based on a voltage received from said first signal terminal.

3. The connection checking system as set forth in claim 2, wherein:

said connecting member further includes a ground cable; and when said connecting member is connected to said electronic device, said first signal cable and said ground cable are connected via a second resistance in said electronic device.

4. The connection checking system as set forth in claim 3, wherein:

said first resistance and said second resistance satisfy the condition of:

R2/R1>1, wherein R1 is a resistance value of said first resistance and R2 is a resistance value of said second resistance.

5. The connection checking system as set forth in claim 4, wherein:

the resistance value R1 of said first resistance and the resistance value R2 of said second resistance satisfy the condition of:

$$R2/R1 \geqq 3.$$

6. The connection checking system as set forth in claim 1, further comprising:

a second signal terminal for sending a signal outputted from said control signal to other members in the electronic device via a second signal cable in said electric device, wherein said second signal terminal is an input/output terminal which can be functioned both as an output terminal and an input terminal; and when said connecting member is connected to said electronic device, said first signal cable and said second signal cable are connected in said electric device; and said control section makes a determination on the connected state of said connecting member based on a voltage of said first signal terminal as received via said second signal terminal.

7. The connection checking system as set forth in claim 6, wherein:

said control section sets an output of said first signal terminal to a high impedance state when making a determination on the connected state of said connecting member.

8. The connection checking system as set forth in claim 6, wherein:

when said connecting member is connected to said electric device, said first signal cable and said second signal cable are connected via a third resistance in said electronic device; and said second signal cable is connected to ground via a fourth resistance.

9. The connection checking system as set forth in claim 8, wherein:

said first resistance, said third resistance and said fourth resistance satisfy the condition of:

$$R4/(R1+R3)>1,$$

wherein R1 is a resistance value of said first resistance, R3 is a resistance value of said third resistance, and R4 is a resistance value of said fourth resistance.

10. The connection checking system as set forth in claim 9, wherein:

the resistance value R1 of said first resistance, the resistance value R3 of said third resistance, and the resistance value R4 of said fourth resistance satisfy the condition of:

$$R4/(R1+R3)\geqq 3.$$

11. The connection checking system as set forth in claim 1, wherein:

said unit is an external device which is separately provided from said electronic device.

12. A connection checking system for checking a connected state of a connecting member for connecting an electronic device and a unit, comprising:

a connecting member which includes a power supply cable for supplying power supply voltage from said electronic device to said unit, a first signal cable for sending a control signal as outputted from a first signal terminal of said electronic device to said unit, and a ground cable; and when said connecting member is connected to said unit and the electronic device, the first signal cable and the ground cable are connected via a fifth resistance in said unit, and said first signal cable and said power supply cable are connected via a sixth resistance in said electronic device; and a control section makes a determination on the connected state of said connecting member based on a voltage applied to said first signal terminal.

13. The connection checking system as set forth in claim 12, wherein:

said unit is an external device which is separately provided from said electronic device.

14. A printer device provided with a connection checking system for checking a connected state of a connecting member which connects an electronic device and a unit, wherein said connection checking system comprises: a connecting member which includes a power supply cable for supplying a power supply voltage from an electronic device to a unit, and a first signal cable for sending a control signal as outputted from a first signal terminal of said electronic device to said unit; and a control section which makes a determination on the connected state of said connecting member, wherein when said connecting member is connected to said unit, said first signal cable is connected to said power supply cable via a first resistance in said unit; and said control section makes a determination on the connected state of said connecting member based on a voltage applied to said first signal terminal.

15. The printer device as set forth in claim 14, further comprising:

an operating section which receives an instruction from a user, and displays a message for the user, wherein when receiving an instruction in relation to the unit which is not connected to said electronic device by the connecting member, said control section controls said operating section to display a message indicative of that the unit is not connected.

16. A printer device provided with a connection checking system for checking a connected state of a connecting member which connects an electronic device and a unit, wherein said connection checking system comprises: a connecting member which includes a power supply cable for supplying power supply voltage from said electronic device to said unit, a first signal cable for sending a control signal as outputted from a first signal terminal of said electronic device to said unit, and a ground cable; and when said connecting member is connected to said unit and the electronic device, the first signal cable and the ground cable are connected via a fifth resistance in said unit, and said first signal cable and said power supply cable are connected via a sixth resistance in said electronic device; and said control section makes a determination on the connected state of said connecting member based on a voltage applied to said first signal terminal.

17. A method of checking a connected state of a connecting member which connects an electronic device and a unit, wherein:

a connecting member includes a power supply cable for supplying a power supply voltage from an electronic device to a unit, and a first signal cable for sending a control signal as outputted from a first signal terminal of said electronic device to said unit; and when said connecting member is connected to said unit, said first signal cable is connected to said power supply cable via a first resistance in said unit, said method comprising the step of determining a connected state of said connecting member based on a voltage value applied to said first signal terminal.

* * * * *